US007980015B2

(12) United States Patent
Moy

(10) Patent No.: US 7,980,015 B2
(45) Date of Patent: Jul. 19, 2011

(54) BOBBLEHEAD SIGN DISPLAY

(75) Inventor: Aaron Yut-Ming Moy, Eden Prairie, MN (US)

(73) Assignee: Bobblesigns.com LLC, Eden Prairie, MN (US)

( * ) Notice: Subject to any disclaimer, the term of this patent is extended or adjusted under 35 U.S.C. 154(b) by 229 days.

(21) Appl. No.: 12/170,438

(22) Filed: Jul. 10, 2008

(65) Prior Publication Data

US 2009/0038187 A1 Feb. 12, 2009

Related U.S. Application Data

(60) Provisional application No. 60/954,815, filed on Aug. 9, 2004.

(51) Int. Cl.
*G09F 19/08* (2006.01)

(52) U.S. Cl. ..... 40/421; 40/538

(58) Field of Classification Search ..... 40/611.11, 40/613, 411, 421, 424, 425, 485, 538; 446/384, 446/396, 487; D21/399, 467, 481
See application file for complete search history.

(56) References Cited

U.S. PATENT DOCUMENTS

| | | | | |
|---|---|---|---|---|
| 1,167,502 | A * | 1/1916 | Huffman et al. | 40/455 |
| 1,600,998 | A | 9/1926 | Russell | |
| 4,578,888 | A * | 4/1986 | Gomez | 40/411 |
| 4,656,768 | A | 4/1987 | Thigpen | |
| 4,793,081 | A | 12/1988 | Andrae | |
| 5,276,424 | A | 1/1994 | Hegemann | |
| 6,511,359 | B1 | 1/2003 | Lui | |
| 6,810,611 | B2 | 11/2004 | Yarnall | |
| 7,517,271 | B1 * | 4/2009 | Alfaro | 446/359 |

* cited by examiner

*Primary Examiner* — Joanne Silbermann

(57) ABSTRACT

One embodiment of a bobblehead sign display contains a body portion (12) and a head portion made up of head substrates (10 and 11). Head substrates (10 and 11) are joined together by head spacers (14 and 15) using an adhesive or reusable fastener. An elastic cord (16) spans a distance between head spacers (15). A support rod (13) is rigidly attached to the body substrate (12). The weight of the assembled head portion is supported by the support rod (13) via a connection to the elastic cord (16). Graphics may be affixed to the outer surfaces of 10, 11 and 12, which will be viewable to spectators around the device.

2 Claims, 11 Drawing Sheets

14
10
17
16
24
29
24
29
13
12

BOBBLEHEAD SIGN DISPLAY

CROSS-REFERENCE TO RELATED APPLICATIONS

This application claims the benefit of provisional patent application Ser. No. 60,954,815, filed 2007 Aug. 9 by the present inventor.

FEDERALLY SPONSORED RESEARCH

Not Applicable

SEQUENCE LISTING OR PROGRAM

Not Applicable

BACKGROUND

1. Field of Invention

This invention relates to signs with motive capabilities.

2. Prior Art

Signs are ubiquitous throughout civilization. In order to be effective, signs must attract the attention of the target audience. As such, inventors have come up with methods to make their devices stand out. U.S. Pat. No. 1,600,998 to Russell (1926) describes an advertising display which mimics human arm movement through electromechanical means. In U.S. Pat. No. 4,793,081 (1988) Andrae and Seiberlich developed a sign consisting of a human face with a mouth capable of changing position. Thigpen, in his U.S. Pat. No. 4,656,768 (1987), also used a movement approach by describing a sign with simulated human arms which rotated due to impact from wind. All of these devices are meant for fixed installation, and their visual appearance is not easily changeable.

In his U.S. Pat. No. 5,276,424 (1994), Hegemann used electronic flashing lights on a sign to attract attention. While this device had the possibility of being portable, the strobe action of the lights had limited application due to brightness of the surrounding ambient and the desired tone of the product or action to be advertised.

Bobblehead dolls are three-dimensional sculptures which feature a head and body crafted to resemble a person, animal or character. The sculpted head component is usually larger in scale than the body it is attached to. The head is also connected to the body through a non-rigid means, such that the head moves in short and seemingly unpredictable directions. Both the relative size of the skull and spasmodic motion combine to create a comic effect. Modern incarnations of bobblehead dolls began in the 1950s, and often utilized the likenesses of athletes and celebrities.

Although these dolls continue to be popular promotional and collectors items, they have properties that limit their deployment. Namely, bobblehead dolls are small in size and expensive to manufacture. Current bobblehead dolls range from 3 to 12 inches in height. Larger sizes would render them too heavy or unwieldy. Also, due to the three-dimensional shape, artists must sculpt and design customized injection molds or dies in order to mass produce a particular figure.

In Yarnall's U.S. Pat. No. 6,810,611 (2004) and Lui's U.S. Pat. No. 6,511,359 (2003), both inventors attempted to improve the ease of customization by adding the ability to insert photographs into the head-shape of the bobblehead figurines. However, these devices remained small, and the three-dimensional body shapes were fixed.

A scene from the Warner Brothers motion picture "Blazing Saddles" (1974) depicted life-sized photographic cutouts of local townspeople characters. The photographs of the heads were proportionately sized to the respective bodies, and both the head and body portions lay in the same geometrical plane. Movement of the head was limited to a side to side swaying motion. Such devices were meant to accurately simulate the appearance of human beings in both size and shape. Said cutouts were also fixed to the ground and aesthetically viewable only from one side. That is, the back side of the cutout figure did not look the same as the front side.

SUMMARY

In accordance with one embodiment a bobblehead sign comprises the image of a disproportionately large face or head loosely affixed to a panel representing a person's, animal's or character's body in such a manner that the head portion of the device can appear to bobble or jiggle relative to the body portion.

DRAWINGS

Figures

FIG. 11 is the bottom view of the part used in an alternative embodiment where a single piece provides support cord attachment and tilt limitation showing how a hollowed out area in this part permits a support rod to pass through.

REFERENCES NUMERALS

Figure 1:
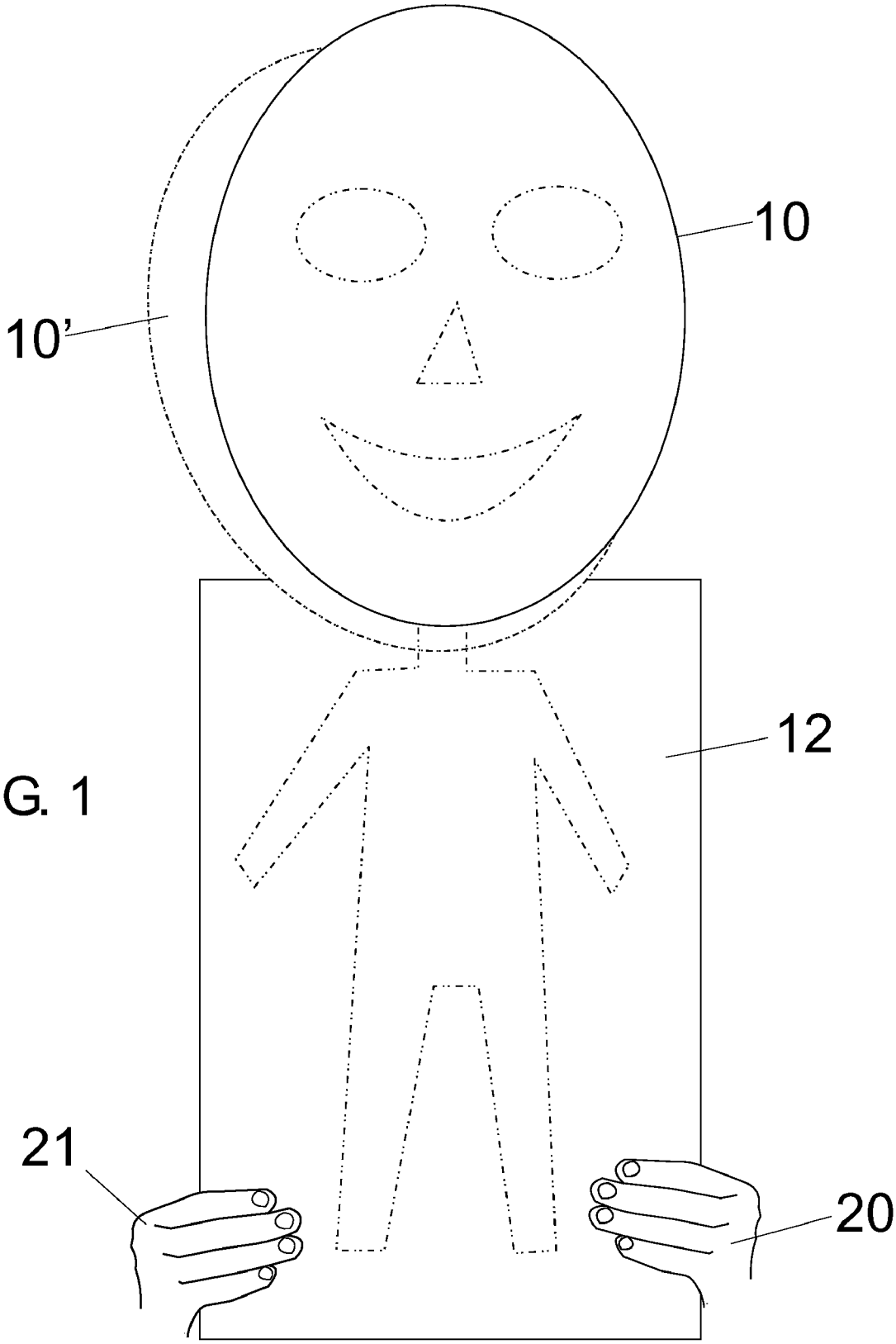
FIG. 1 is a front view of the device in operation.

10 Primary head substrate
10' Primary head substrate in an alternate position due to motion
11 Secondary head substrate
12 Body substrate
13 Support rod
14 Head spacer
15 Tilt limiter and head spacer
16 Support cord
17 Support cord plug
20 Human left hand
21 Human right hand
24 Head spacer and support cord attachment part in an alternative embodiment
26 One piece head spacer and tilt limiter in an alternative embodiment
27 Spring coil support in an alternative embodiment
28 Spring coil connector in an alternative embodiment
29 Tilt limiter in an alternative embodiment
41 Elastic part providing support from below
42 Elastic part providing support from above

DETAILED DESCRIPTION

FIGS. 1 Thru 6

Preferred Embodiment

Figure 2:
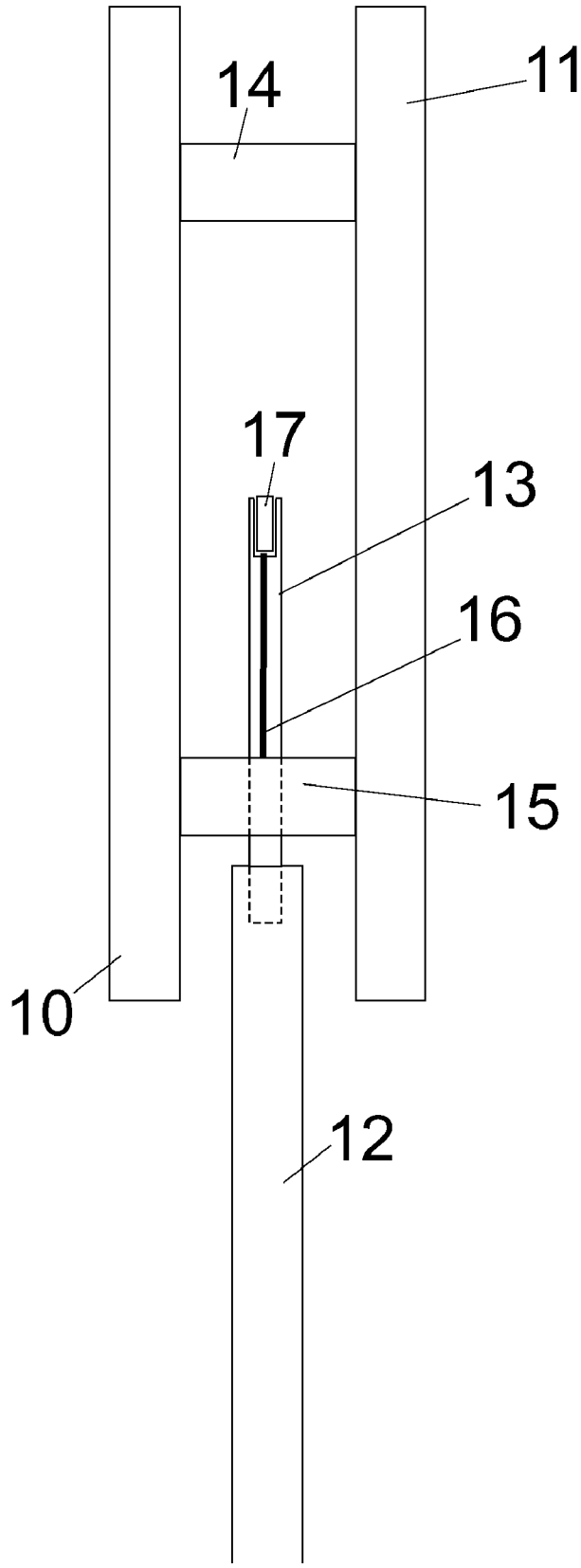
FIG. 2 is a side view of the device when assembled.
Figure 3:
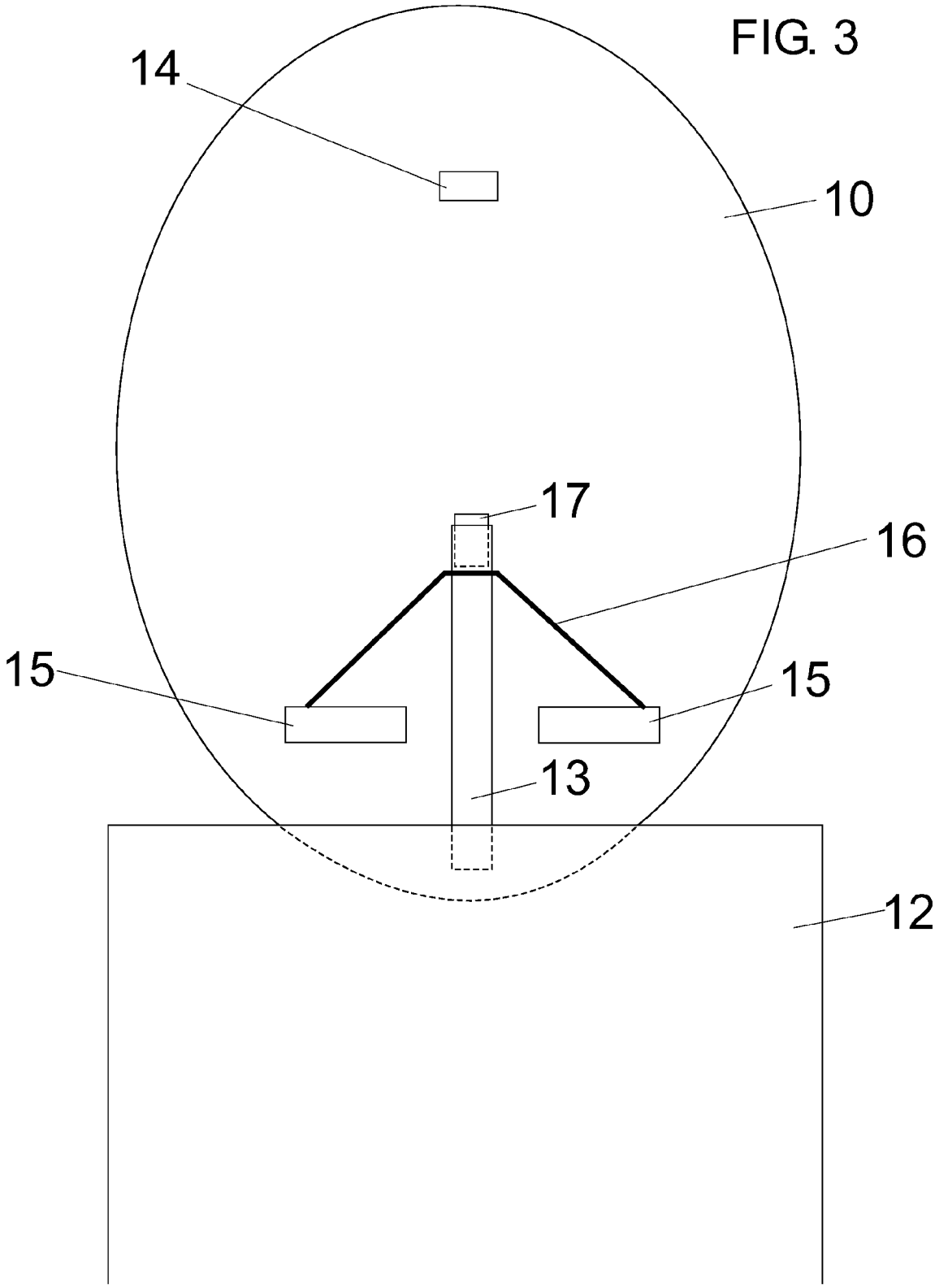
FIG. 3 is a front view of the device with one of the two head substrate pieces removed to expose the inner support structure.
Figure 6:
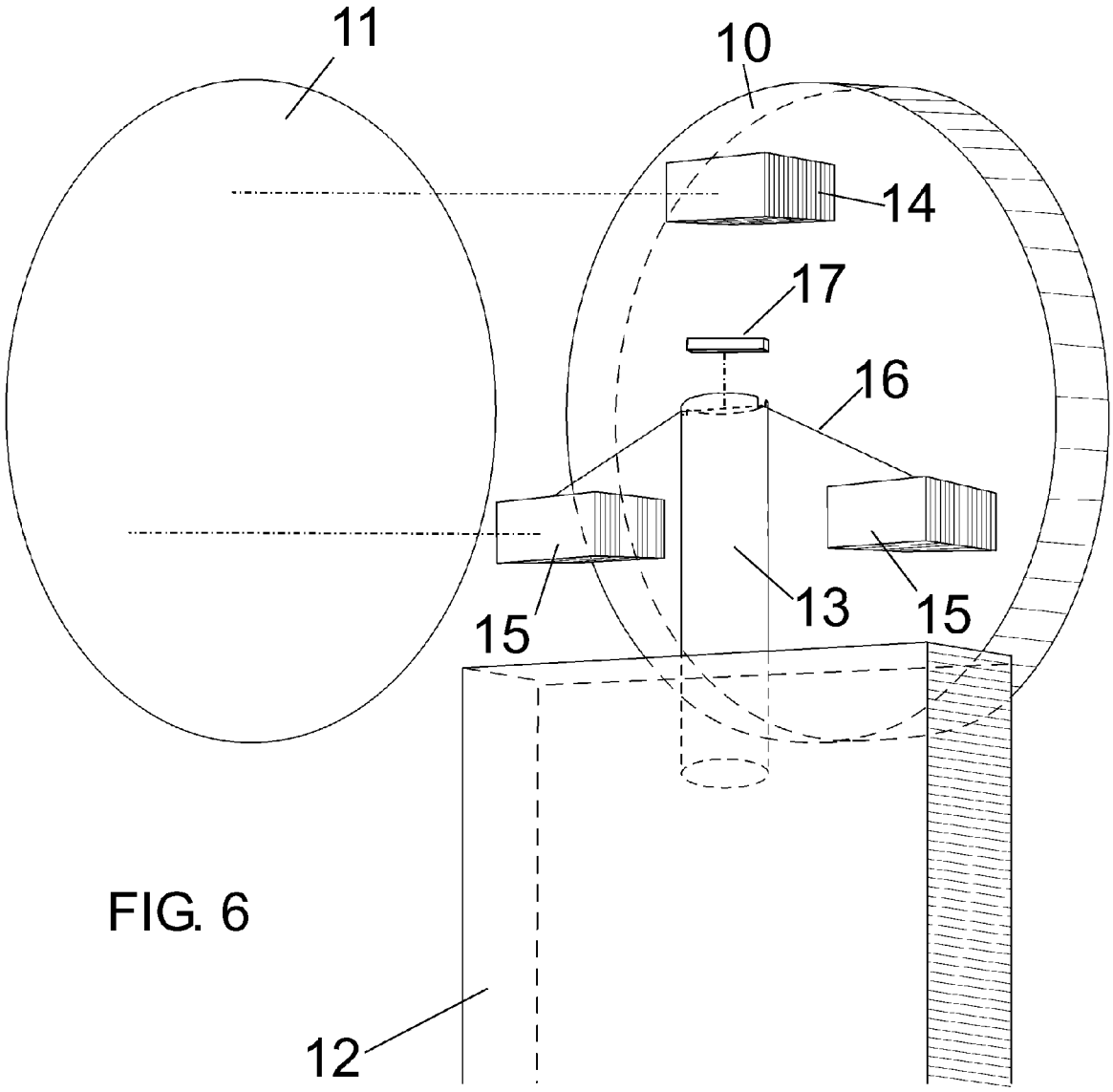
FIG. 6 is an exploded perspective view showing the parts of the device in relation to one another.

One embodiment of the sign is illustrated in FIG. 1 (front assembled view), FIG. 2 (side assembled view), FIG. 3 (dissembled view), and FIG. 6 (exploded perspective view). FIG. 1 is a view of the assembled device from the front when the user grasps on to the body 12 using left 20 and right 21 hands. Body substrate 12 can be cut from 3⁄16-inch thick foam core board or similar material for an example body substrate size of 20-inches wide by 30-inches tall. The head portion 10 can be cut from a sheet of stiff cardboard or foam core board. Head substrates 10 and 11 appear to loosely float above the body 12 after assembly, with 10 and 11 having limited movement relative to 12. In the preferred mode, the bottom portions of head substrates 10 and 11 extend below the top of body substrate 12, as illustrated in FIG. 1. This design feature conceals the inner support structure of the device to the casual observer.

A graphic image of a person's or character's head or face can placed on the outer viewable sides of 10 and 11, and a graphic image of the respective body can placed on 12. As defined here, the outer side of 10 and 11 is the side of the head substrate that will be viewable to spectators after complete assembly of this device. The inner side of 10 and 11 is the side facing support rod 13 to be discussed in a subsequent paragraph. 10' of FIG. 1 depicts the head portion in a different position relative to the body due to motion. For the purposes of illustration, a crude human face and body are depicted in phantom lines. The device described herein may be constructed with or without graphics on 10, 11 and 12.

In the preferred embodiment, the relative size of the head substrates 10 and 11 disproportionately large to the body size depicted on body substrate 12, as depicted in FIG. 1. Although head substrates 10 and 11 are shown as an oval, they may be of any other shape. Likewise, body substrate 12 is shown as rectangular, but it may be of any other shape. The choice of materials for 10 and 12 can vary based on size of the completed device.

FIG. 2 is a side view of the assembled device. Support rod 13 extends into body substrate 12 such that 12 and 13 form a rigid structure. Support rod 13 may be made from any stiff material, such as metal or plastic, and may be of any convenient shape, such as round or polygonal. Adhesive may be added between 12 and 13 to increase structural strength. In one embodiment the top of support rod 13 has a groove in it to facilitate the placement of an elastic support cord 16. Support cord 16 may be made from any cord or band with elastic properties, such as rubber, with sufficient strength as to be able to support the weight of the completed head assembly made up of parts 10, 11, 14, and 15.

FIG. 3 is a view of the device with head substrate 11 removed. This view illustrates how the head substrates 10 and 11 are suspended by support rod 13 via the support cord 16, although 11 is not shown in this figure. In one embodiment support cord 16 is secured to support rod 13 using support cord plug 17. Each end of support cord 16 is attached to a head spacer 15. Head spacers 14 and 15 can be made from a material such as solid foam, and they connect to head substrates 10 and 11. Head substrates 10 and 11 are identically sized and shaped in the preferred embodiment. Head spacers 14 and 15 are of sufficient thickness such that the inner surfaces of head substrates 10 and 11 are not necessarily in constant contact with body substrate 12 when viewed from the side as FIG. 2 demonstrates. Head spacer 14 may be omitted from the constructed assembly should head spacers 15 be large enough to provide sufficient stability. Multiple head spacers 14 may be added to increase stability of the assembled head portion.

Referring to FIG. 3, head spacers 14 and 15 are attached to inner surfaces of head substrates 10 and 11 with adhesive or reusable binding, such as hook-and-loop fastener or magnet. Each end of support cord 16 is fastened to head spacers 15 by any convenient means, such as but not limited to adhesive, knot tying or stapling. Because support cord 16 has elastic properties, the head substrates 10 and 11 can move up and down, side to side, or tilt relative to body substrate 12 after assembly. The degree of tilt by the head substrates is limited by the distance between the inner edges of head spacers 15 and support rod 13. The position and movement properties of head substrates 10 and 11 can be controlled by selecting the length and elastic strength of support cord 16 and the distance between head spacers 15 and support rod 13.

Figure 4A:
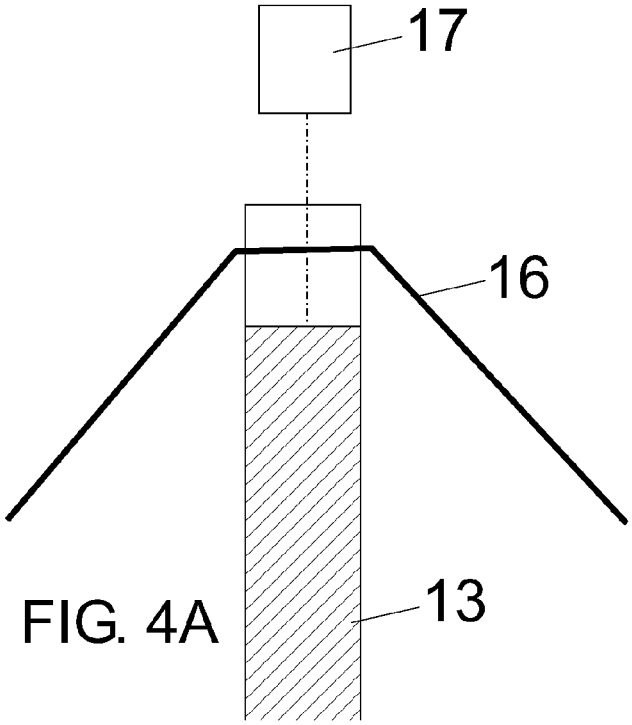
FIG. 4A is a cross-sectional exploded view from the front of the device showing how the elastic cord attaches to the support rod in the preferred mode.
Figure 4B:
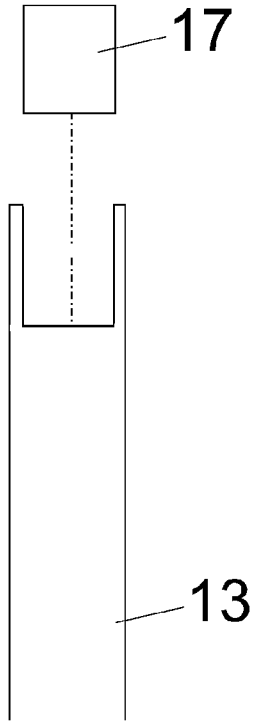
FIG. 4B is a side exploded view of the support rod showing the groove into which the support cord lies.

FIG. 4A shows a close up, exploded, cross-sectional view of how the support cord 16 may be secured to support rod 13 in the preferred embodiment. A groove exists at the top of support rod 13 as shown in FIG. 4B. Support cord 16 is placed in the groove at the top of support rod 13. Support cord plug 17 is then placed in the groove of support rod 13, and may be held in position with a product such as, but not limited to, adhesive, staple or screw thread.

Figure 5:
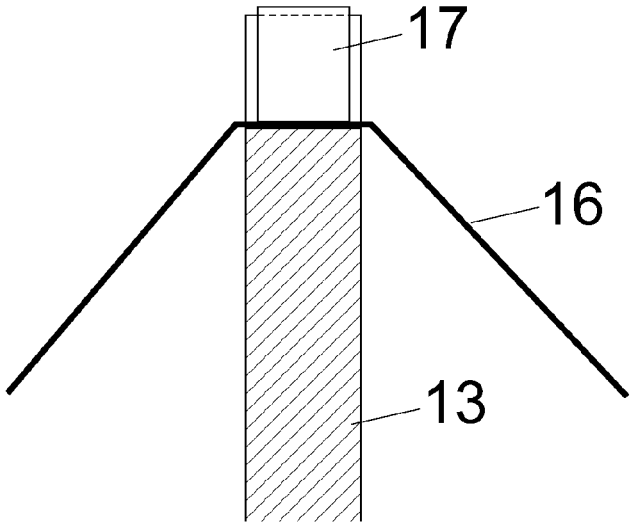
FIG. 5 is a front view of the elastic cord after it is assembled to the support rod in the preferred mode.

FIG. 5 shows a close up, cutaway view of support cord 16 after it is secured to support rod 13 by support cord plug 17 in the preferred embodiment. Support cord plug 17 keeps support cord 16 inside the groove of support rod 13. Support cord plug 17 also prevents support cord 16 from moving laterally within the groove of support rod 13.

FIG. 6 displays the apparatus in exploded, perspective view. In this preferred embodiment, head substrate 11 connects with head substrate 10 through the three points of contact, head spacers 14 and 15. FIG. 6 shows two phantom lines demonstrating where head substrate 11 meets head spacers 14 and 15. A third phantom line, connecting the second head spacer 15 to head substrate 11, is not shown to improve the drawing's clarity. A phantom line between support cord plug 17 and the support rod 13 shows where 17 inserts into the top of 13 to secure support cord 16.

Operation—FIGS. 1 through 6

In assembling the device, graphics may be printed on or affixed to the outer (viewable) side of head substrates 10 and 11 (11 not shown) and body substrate 12 of FIG. 1. Graphics may be omitted during the assembly process and added at a later time following the completed construction of the device. In the preferred embodiment, head spacers 14 and 15 are affixed to the inner surface of head substrate 10 as depicted in FIG. 3 with adhesive. Head spacer 14 may be omitted from the constructed assembly should head spacers 15 be large enough to provide sufficient stability. Multiple head spacers 14 may be added to increase stability of the assembled head portion. The support rod 13 is inserted in or attached to body substrate 12 in FIG. 3. Support cord 16 is affixed to each of the two head spacers 15 as shown in FIG. 3.

Support cord 16 is then attached to the top of support rod 13 as depicted in FIG. 4A. In the preferred embodiment, support cord 16 is then secured to support rod 13 using support cord plug 17 as shown in FIG. 5. Head substrate 11 is then attached to head spacers 14 and 15 using a hook and loop fastener in the preferred embodiment, forming the structure as seen in side view in FIG. 2.

In operation in the preferred mode the user will hold the body substrate 12 in their hands, with head substrates 10 and 11 above 12, providing a slight shaking or rocking motion (FIG. 1). This motion in turn will cause the head substrates 10 and 11 to bobble relative to the body substrate 12. If the appropriate graphics are printed, the sign will appear the same from the front view and the rear view. The manufacturer may also choose to utilize different graphics such that the front side of the device does not appear the same as the back side, or to use no graphics at all.

Additional Embodiments

FIGS. 7 Through 14

Figure 7:
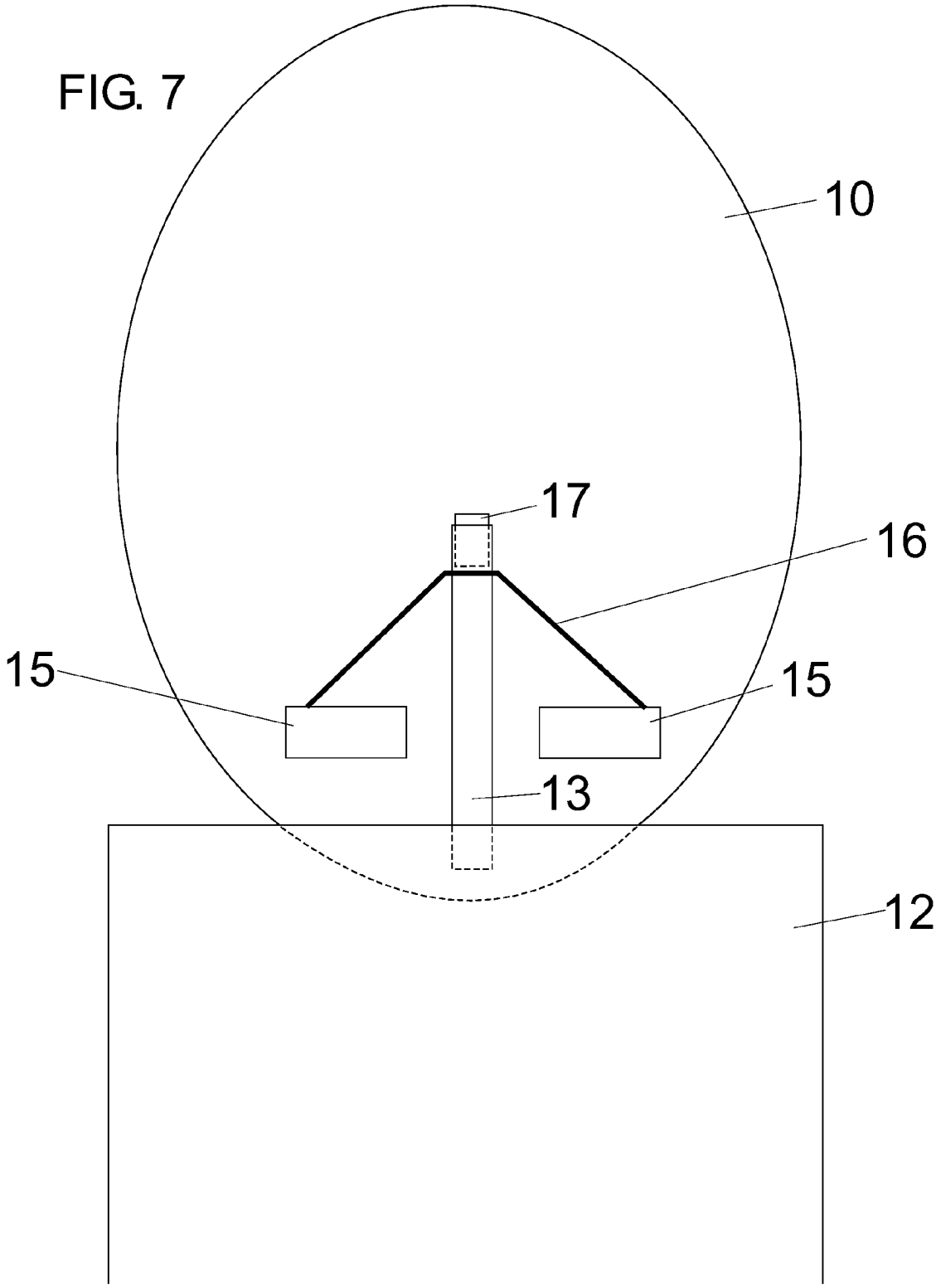
FIG. 7 is a front view of the device with one of the two head substrate pieces removed in an alternative embodiment where a head spacer piece is not used.
Figure 8:
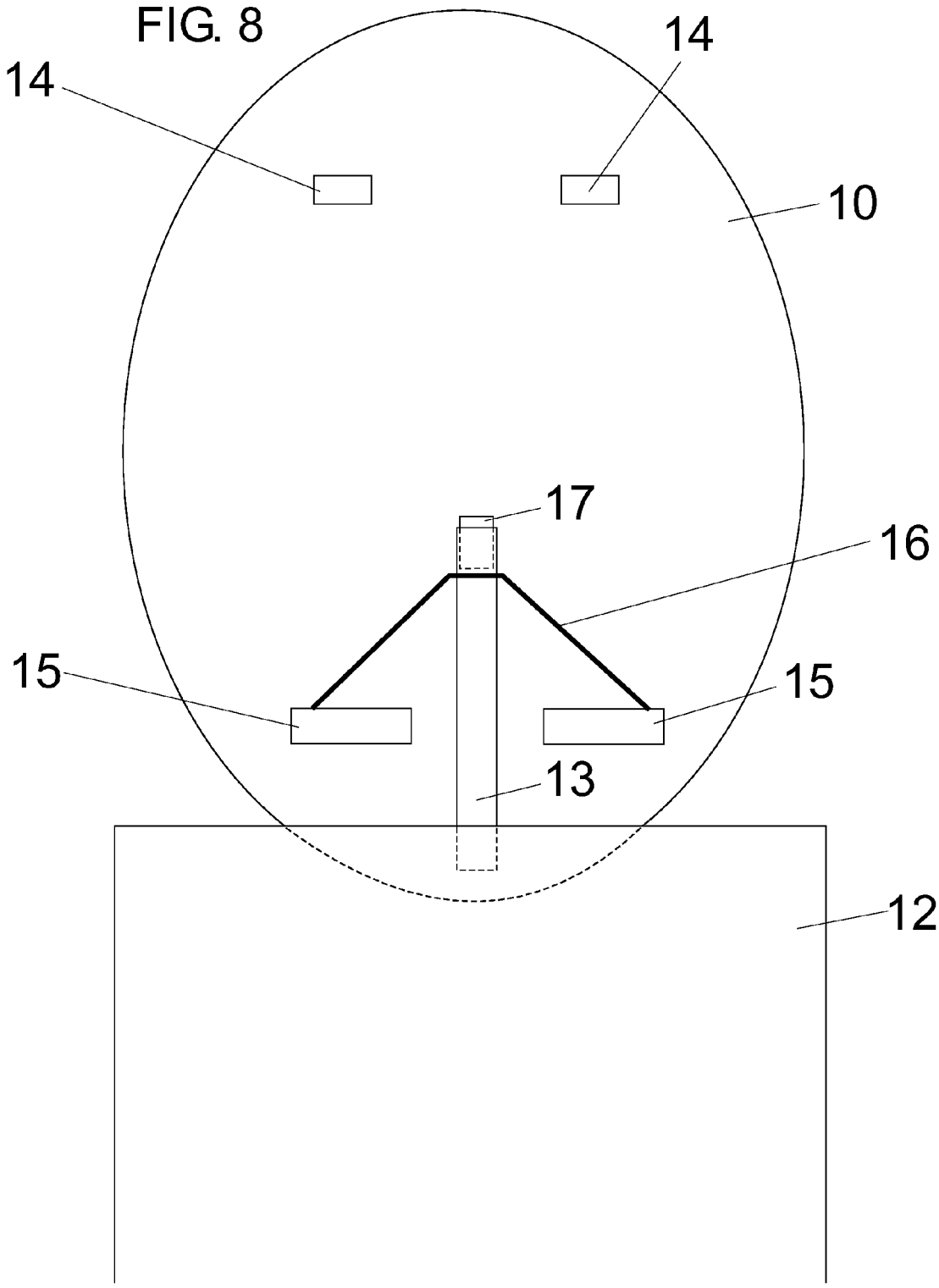
FIG. 8 is a front view of the device with one of the two head substrate pieces removed in an alternative embodiment where additional head spacer pieces are used.

Additional embodiments are shown in FIGS. 7-16. In each additional embodiment the external appearance of the device remains the same to the casual viewer. Changes are only made to the internal mechanisms of the device. FIG. 7 shows the construction of the sign without utilizing head spacer 14. In this instance head spacers 15 provide enough support to keep head substrates 10 and 11 connected. Alternatively, FIG. 8 shows the embodiment utilizing multiple head spacers 14. Adding more head spacers 14 increases the points of contact between head substrates 10 and 11, increasing the strength of the construction.

Figure 9:
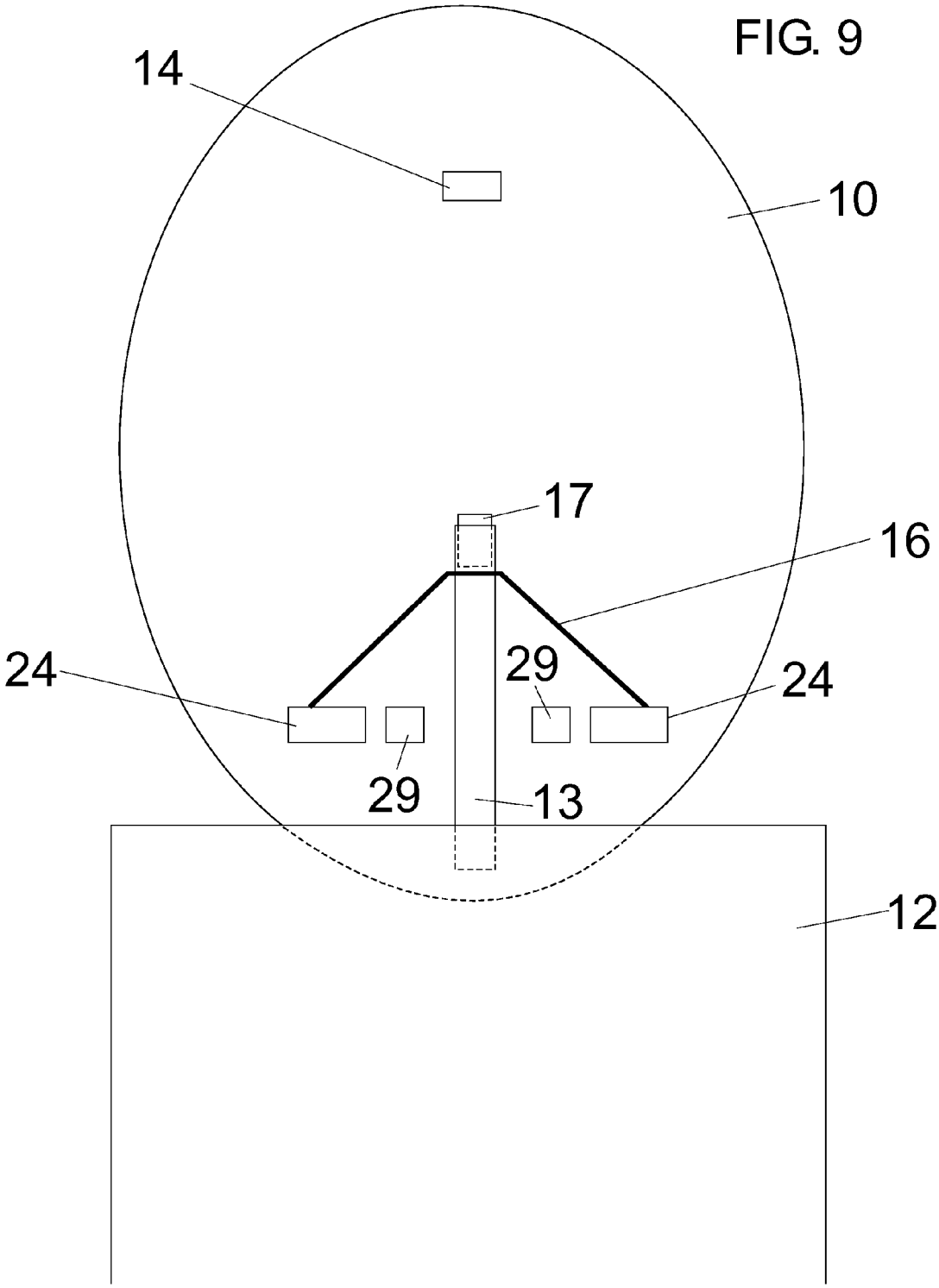
FIG. 9 is a front view of the device with one of the two head substrate pieces removed in an alternative embodiment where separate parts are used for support cord attachment and tilt limitation.

FIG. 9 shows the embodiment where the tilt limiter and head spacer pieces 15 are replaced by two separate parts 24 and 29. Head spacers 24 serve as points of attachment for the support cord 16. The distance between tilt limiters 29 and support rod 13 control amount of tilt.

Figure 10:
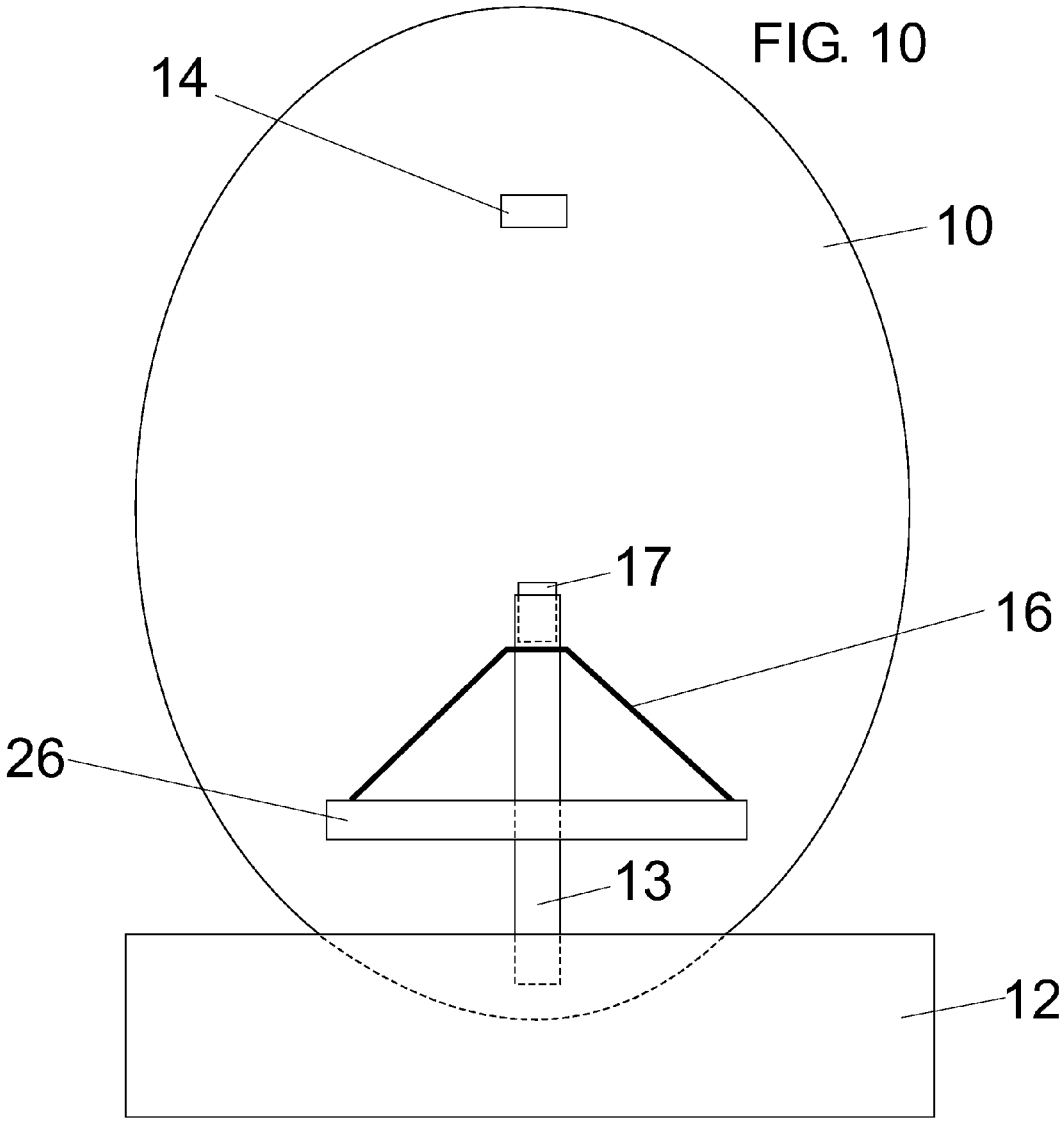
FIG. 10 is a front view of the device with one of the two head substrate pieces removed in an alternative embodiment where a single part is used to both provide support cord attachment and tilt limitation.
Figure 11:
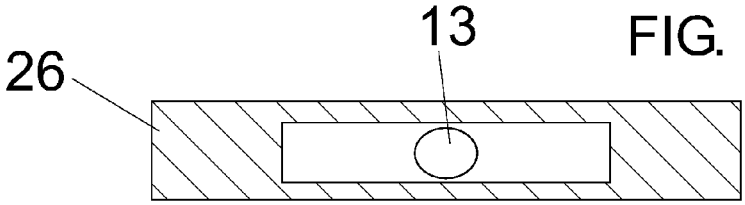

FIG. 10 shows an embodiment where the two head spacers 15 are instead replaced by a single head spacer and tilt limiter 26. Head spacer and tilt limiter 26 has a hollowed portion through it to allow the support rod 13 to pass through. FIG. 11 shows a bottom view of head spacer and tilt limiter 26, demonstrating how support rod 13 passes through the hollow area. In this embodiment, head spacers 14 may be omitted, or additional head spacers 14 may be added.

Figure 12:
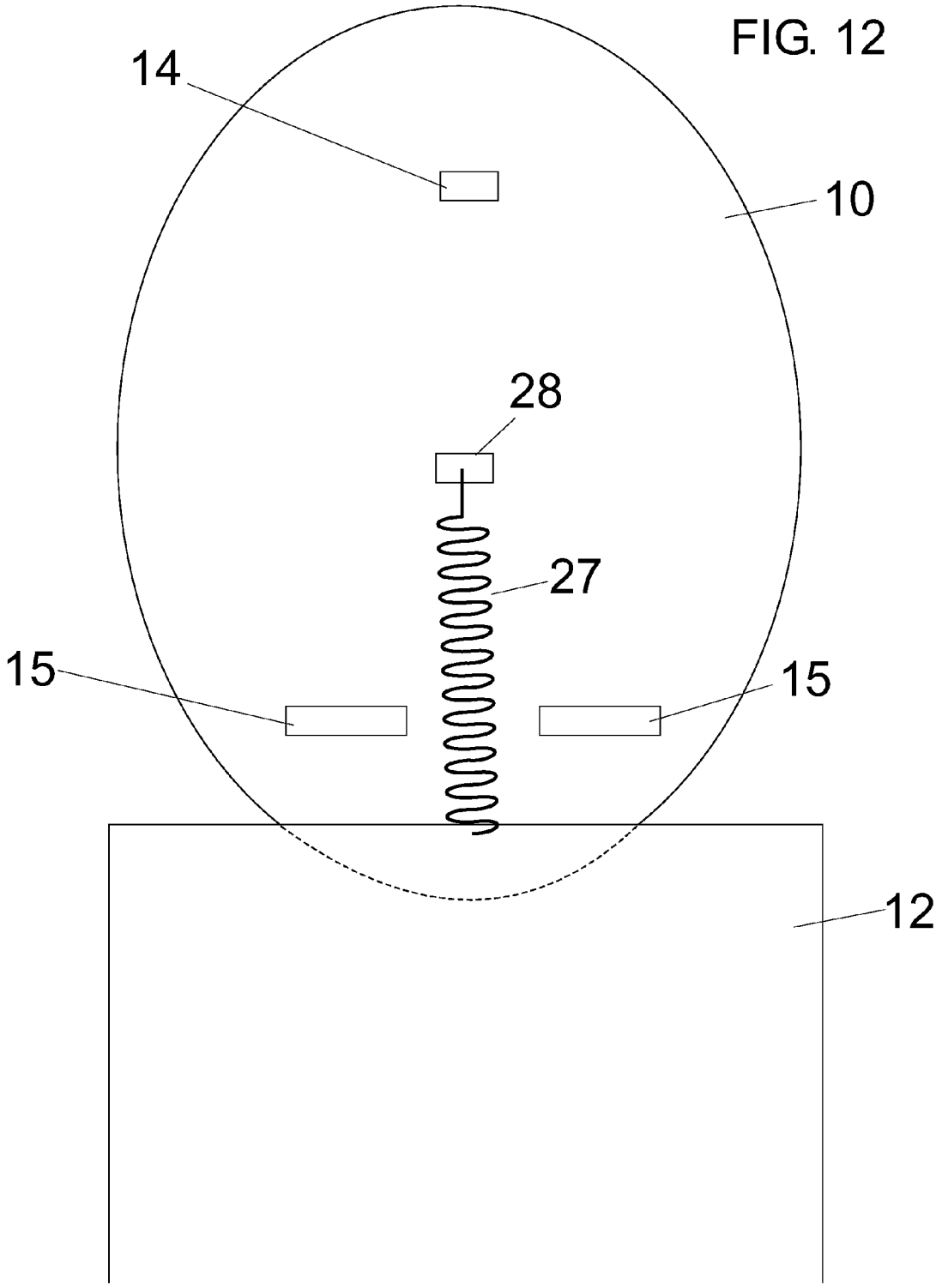
FIG. 12 is a front view of the device with one of the two head substrate pieces removed in an alternative embodiment where support is provided by a spring instead of a support cord.

FIG. 12 shows the embodiment where the support rod 13 and support cord 16 are replaced by a spring coil 27. One end of spring coil 27 is connected to body substrate 12, and the opposite end is connected to spring connector 28. Spring connector 28 is then attached to head substrates 10 and 11. Thus, weight of head substrates 10 and 11 are supported by spring coil 27 via spring connector 28. Indeed, spring coil 27 need not necessarily be a true spring coil, but can be replaced by another elongated part which features lateral flexibility and longitudinal rigidity.

Figure 13:
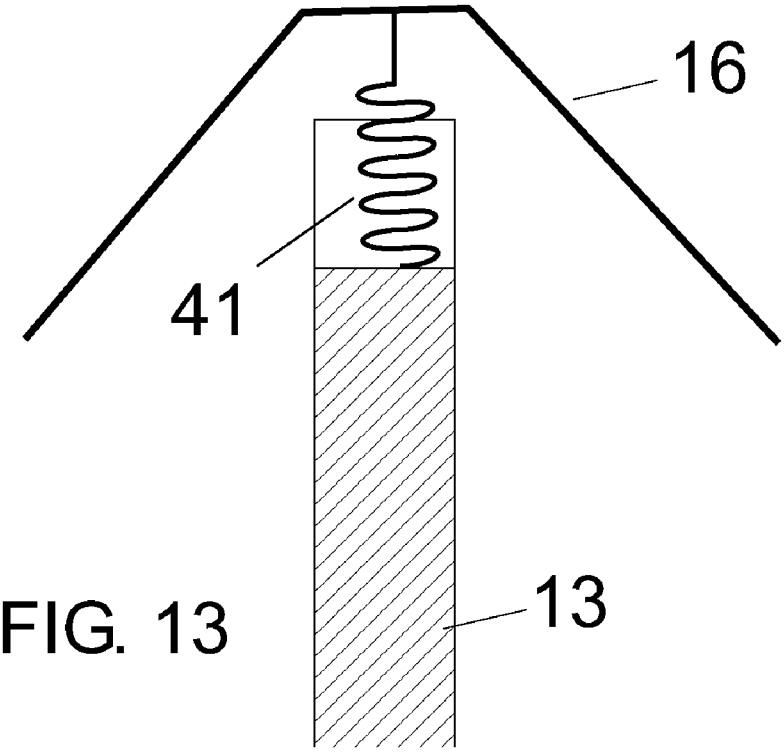
FIG. 13 is a cross sectional view of the support rod in an alternative embodiment where the support cord is supported from underneath by a part with elastic properties.
Figure 14:
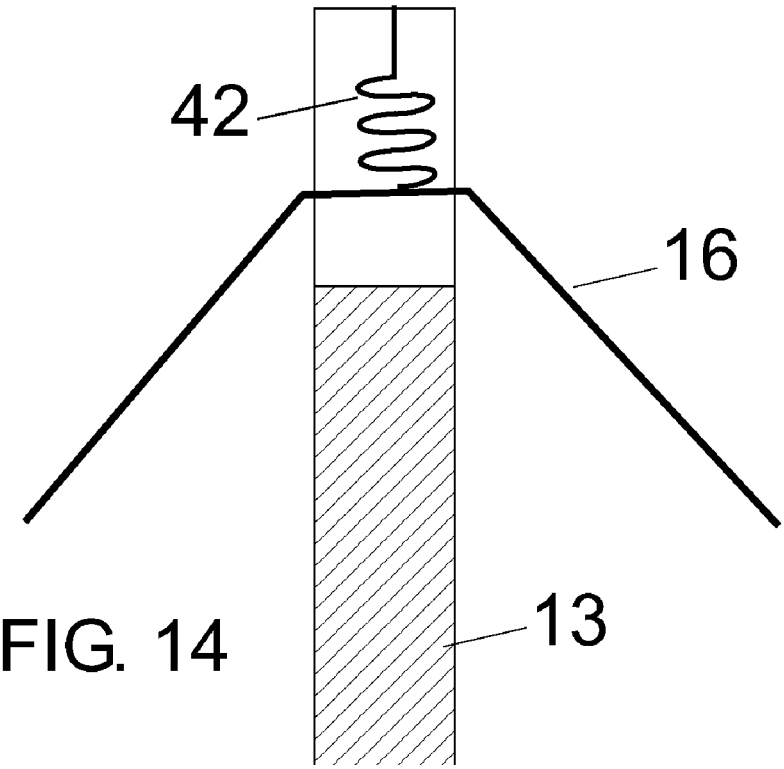
FIG. 14 is a cross sectional view of the support rod in an alternative embodiment where the support cord is supported from above by a part with elastic properties.

Additional embodiments can also change how support cord 16 is secured to support rod 13. A groove in support rod 13 may not be necessary if support cord 16 is held in place with a knot, adhesive, staple, nail or similar. Support cord 16 need not be one single piece, but said cord may be made of multiple pieces which join at support rod 13. An intermediate part 41 with elastic properties could also connect to support cord 16 from beneath, as illustrated in FIG. 13. In this embodiment, 41 is rigidly connected to 13, and 41 provides more of the elastic deformity instead of 16 when the device is operated. Similarly, support cord 16 could be hung from a part with elastic properties 42, with 42 being securely attached to 13 as shown in FIG. 14. Here the weight of the head portion of the assembled bobblehead sign pulls down on 42 via support cord 16. Indeed, support cord 16 could be replaced by a rigid support spar instead in these embodiments.

During construction of the device's parts, the manufacturer may choose to combine multiple parts from the design into one single piece when the part is produced. For example, support rod 13 could be made as a portion of the same part as body substrate 12, creating a single object that serves to both support the attachment of body graphics and to support the head structure. Head spacers 14 or 15 could also be part of the same mold used to create head substrates 10 or 11.

Portability of the device can also be enhanced by modifying one or more components. For example, support rod 13 could be made to screw into and out of body substrate 12. Support rod 13 and body substrate 12 could each be made to fold up during storage or transport.

The presence of graphics on the outer portions of 10, 11 and 12 can also be considered an alternative embodiment. That is, graphics may be placed on substrates 10, 11 and 12 before assembly of the device. Alternatively, the parts of the device may be manufactured without adornment, allowing the user to attach graphics at a later time. Indeed, graphics are not limited to flat, two-dimensional images. Three-dimensional shapes or accoutrements could also be affixed to the head or body substrates 10, 11 or 12.

In the best mode, the assembled device offers an identical image when viewed from the front or from behind. However, head substrates 10 and 11 may be of different sizes or shapes, or different graphics may be placed on each outer surface such that the appearance of the front side differs from the appearance of the back side. The user may also choose to apply the device in such a way that it is only readily viewable from one side, or the user may omit using one of the head substrates 10 or 11 in the assembly.

Advantages

The innovation of this bobblehead sign invention as described above is that the same comic effect from bobblehead dolls can be achieved using basically a two-dimensional sign display. The head portion of the sign is disproportionately huge and bounces above the body. These signs can be scaled in size, and can easily be made large enough to be recognizable from large distances yet still be light enough to be portable or handheld. A basic bobblehead sign skeleton can be produced, upon which photographs or graphics can be printed or affixed. Thus, the device may be customized merely by printing or drawing new items, without having to redesign the moving parts or support structure.

The bobblehead sign invention offers advantages over bobblehead dolls in that these signs:

(a) can be made in varying sizes from a few inches to many yards in height.

(b) can be disassembled for shipping and transport.

(c) do not require three-dimensional sculpting to customize.

(d) can be re-used simply by changing the affixed graphics.

(e) are highly economical to produce.

CONCLUSION, RAMIFICATIONS, AND SCOPE

Accordingly, the reader will see that bobblehead sign displays provide a means to capture the comic effect of three-dimensional bobblehead doll figurines, but on a larger and more economical scale. A single support structure could be mass produced, and each bobblehead sign made unique simply by affixing different images of people, animals or characters. Economy is further enhanced if the image on the bobblehead sign is the same across a production run.

A bobblehead sign display can be made large enough so as to be seen from large distances while still being managed by a single person. Bobblehead sign displays can also be made to be physically small, in the realm of the size of traditional bobblehead figurines, but with the bobblehead signs being much less costly to produce. Bobblehead signs can also be installed as a device in product displays for the purpose of advertising, where the bobbling head action can be actuated by electromechanical or vibratory means. Bobblehead signs can supplement the role of promotional or souvenir item currently served by bobblehead figurines.

The design of the bobblehead sign offers great flexibility in construction means and materials. Lightweight panels, such as foam core boards or cardboard, are the best choice for low cost and portable embodiments, but any other materials may be chosen. For smaller sized bobblehead signs, use of heavier materials may be favorable. Addition of ballast weights and choice of support cord strength are factors that will affect the bobbling motion of the head portion.

The internal support parts can also be made to be compatible with a wide range of body and head shapes. Oval heads and rectangular bodies are easiest to visualize, but the design permits successful implementation utilizing myriad other shapes for the head or body portions. The support rod need not be limited to any particular shape or cross-section. The manufactured device can also be sold and marketed as a complete, assembled bobblehead sign, or it can be sold as a modular kit. Addition of a handle or grip to the device can allow the user to display the bobblehead sign more prominently or with greater comfort. Because of this device's thin profile, a suction cup could easily be added to the body portion and the bobblehead sign could be mounted onto a window.

Although the description above has presented specificities about size, shape and choice of materials, these should only be considered aids to visualization of the construction and operation of the device and should by no means be interpreted as limitations of the embodiment.

I claim:

1. A method of constructing a display apparatus comprising:

a) selecting two panels for a head portion of the apparatus to which graphics may be affixed, b) attaching spacer blocks to one of said head portion panels, c) selecting a panel for a body portion of the device to which graphics may be affixed, d) attaching a support rod to said body portion of the device, e) attaching each end of a support cord to said spacers such that the support cord spans laterally, f) connecting said support cord to said support rod, g) attaching the remaining head portion panel of said head portion to said spacer blocks, whereby said head portion may be moved relative to said body portion of said display apparatus.

2. The method of claim 1 wherein an electromechanical device is attached to said display apparatus such that the head portion of said display apparatus achieves motion.

* * * * *